US007309115B2

(12) United States Patent
Blum et al.

(10) Patent No.: US 7,309,115 B2
(45) Date of Patent: Dec. 18, 2007

(54) PULL OUT GUIDE ASSEMBLY FOR DRAWERS

(75) Inventors: Egon Blum, Höchst (AT); Ingo Gasser, Höchst (AT); Herbert Isele, Lustenau (AT)

(73) Assignee: Julius Blum Gessellschaft m.b.H., Hochst (AT)

( * ) Notice: Subject to any disclaimer, the term of this patent is extended or adjusted under 35 U.S.C. 154(b) by 381 days.

(21) Appl. No.: 10/645,605

(22) Filed: Aug. 22, 2003

(65) Prior Publication Data

US 2005/0174021 A1 Aug. 11, 2005

(30) Foreign Application Priority Data

Aug. 29, 2002 (AT) ..... GM572/2002
May 6, 2003 (EP) ..... 03010219

(51) Int. Cl.
*A47B 88/04* (2006.01)

(52) U.S. Cl. ..... 312/334.13; 312/334.44; 384/19

(58) Field of Classification Search ..... 312/330.1, 312/333, 334.1, 334.8, 334.12, 334.13, 334.18, 312/334.44; 384/19, 20, 21
See application file for complete search history.

(56) References Cited

U.S. PATENT DOCUMENTS 2,031,251 A * 2/1936 Clark ..... 312/334.13
3,904,254 A 9/1975 Hagen et al.
4,057,303 A 11/1977 Röck et al.
4,089,567 A 5/1978 Röck et al.
4,227,750 A 10/1980 Röck et al.
4,370,007 A 1/1983 Fler
4,458,964 A * 7/1984 Hardy ..... 312/334.12
4,508,394 A 4/1985 Röck et al.
4,659,237 A * 4/1987 Rapp ..... 384/19
5,364,179 A * 11/1994 Brustle et al. ..... 312/333

FOREIGN PATENT DOCUMENTS

DE 3006378 9/1980
DE 4005405 A1 10/1990

(Continued)

OTHER PUBLICATIONS

N. Dean et al., "Novel Thermal Interface Material with Aligned Conductive Fibers", Johnson Matthey Electronics, Spokane, WA, 6 pgs, no date.

(Continued)

*Primary Examiner*—James O. Hansen
(74) *Attorney, Agent, or Firm*—Wenderoth, Lind & Ponack, L.L.P.

(57) ABSTRACT

A pull-out guide assembly for drawers, having on both sides of the drawer a support rail on the carcass and a pull-out rail on the drawer. The load of the drawer is transmitted between the rails by rollers that are borne in running carriages. The running carriages may be moved between a front end position and a rear end position in a differential manner. Locking means are provided for the running carriages and, in the event of a deviation from the differential running between the rails, they lock the running carriage on one of the rails at predetermined points between the two end positions. This locking is releasable by the movement of the rails with respect to one another.

11 Claims, 16 Drawing Sheets

FOREIGN PATENT DOCUMENTS

| | | |
|---|---|---|
| FR | 2608905 | 7/1988 |
| GB | 803331 | 10/1958 |

OTHER PUBLICATIONS

Rudin, A., et al., Fluorocarbon Elastomer Aids Polyolefin Extrusion:, Plastics Engineering, Society of Plastics Engineers, Inc., Greenwich, Conn., US, pp. 63-66, 1986, no month.

Rosenbaum, E., et al., "Boron Nitride as a Porcessing Aid for the Extrusion of Polyolefins and Fluoropolymers", Rapra Abstracts, Pergamon Press, Ltd. Oxford, GB, p. 168, 2000, no month.

Yip, et al., "The Effect of the Boron Nitride on Melt Fracture in Blow Moulding Extrusion", no date.

Hagio et al., "Sintering o fthe Mechanochemically Activated Powders of Hexagonal Boron Nitride", J. Am Cer. Soc., vol. 72, pp. 1482-1484, 1989, no month.

Yip et al., The Effect of the Boron Nitride Type and Concentration ofn the Rheology and Processability of Molten Polymers:, ANTEC 1999, Tech. Papers, 45, New York, 1999, no month.

Rosenbaum, E. et al., "A New Processing Additive Eliminating Surface and Gross Melt Fracture in the Extrusion of Polyolefins and Fluoropolymers", ANTEC 1998, no month.

Seth, et al., "The Effect of Surface Energy of Boron Nitride Powders on Gross Melt Fracture Elimination", ANTEC 2001, no month.

Rosenbaum, E., et al. "Boron Nitride as a Processing Aid for the Extrusion of Polyolefins and Fluoropolymers", Polymer Engineering and Science, vol. 40, No. 1, pp. 179-190, Jan. 2000.

Quotation (Jun. 5, 1998) and Reguest for Quotation Form (May 15, 1998).

Quotation (Dec. 2, 1999) and Request for Quotation Form for Item 1, Item 2, and Item 3 (Nov. 30, 1999).

Phone Call Report (Oct. 20, 1998), Shipment Inforamtion for XP 1115 and Experimental Product Analysis (Oct. 23, 1998).

Quotation (May 19, 1999) and Experimental Product Analysis for XP 11047 (May 18, 1999).

Carborundum Boron Nitride Data Sheet, "Cosmetic Grade Boron Nitride Powders" (Jun. 1998).

"Silicones & Silicon-Containing Polymers," (Petrarch Systems Silanes and Silicones: Silicon Compounds Register & Review (1987), no month.

* cited by examiner

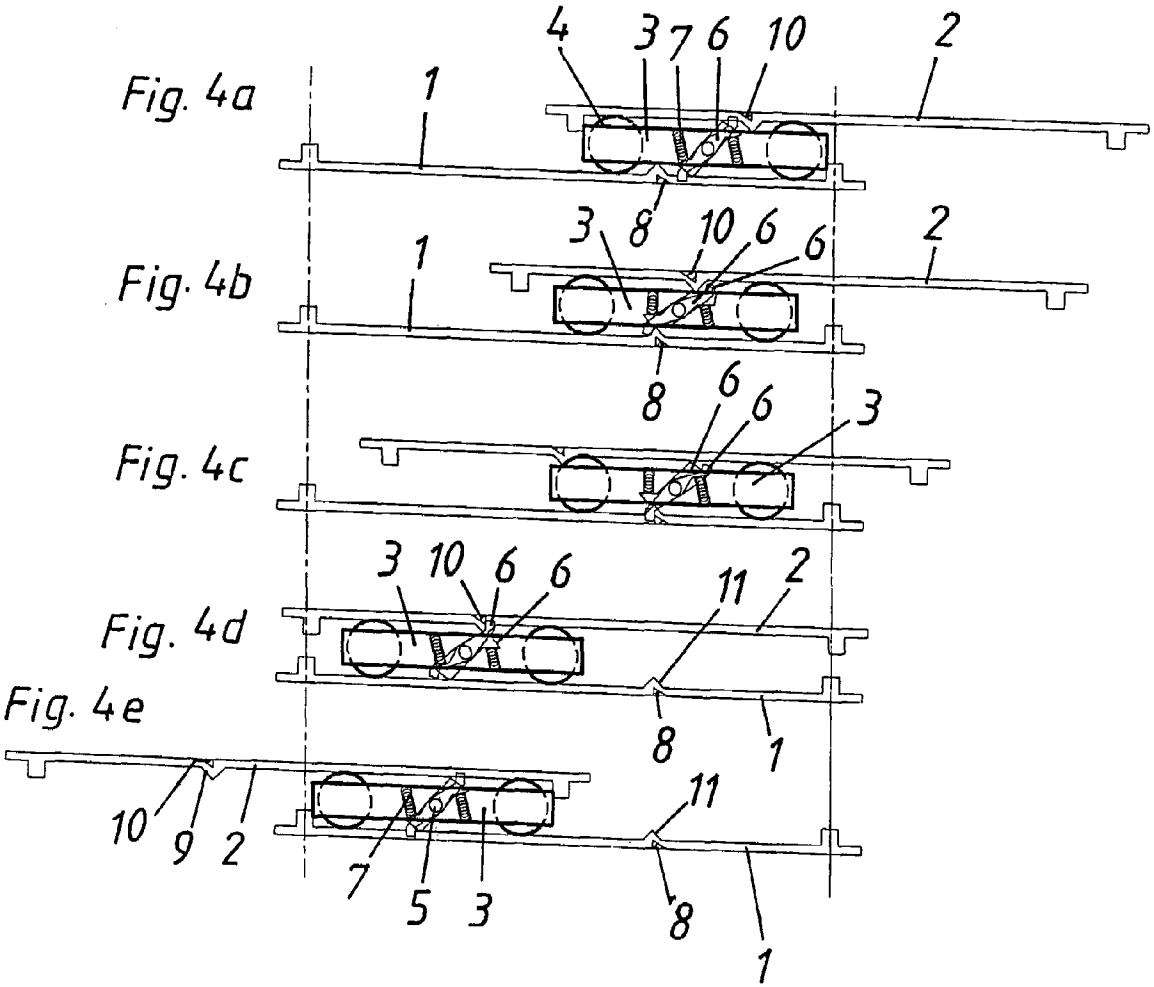
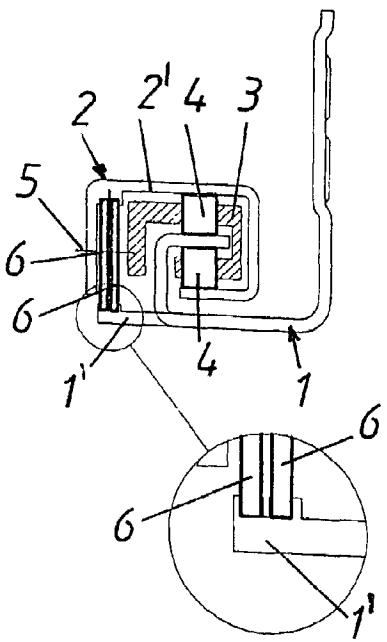
Fig. 5

PULL OUT GUIDE ASSEMBLY FOR DRAWERS

BACKGROUND OF THE INVENTION

The invention relates to a pull-out guide assembly for drawers, having on both sides of the drawer a support rail on the carcass, and a pull-out rail on the drawer with the load of the drawer being transmitted between the rails by rollers that are borne in running carriages running between the rails between a front end position and a rear end position in differential manner, with the running carriages being provided with locking means.

As a result of the slip between the rollers and the guide profiled sections of the rails, it is not always guaranteed that, when the drawer is pulled and/or pushed in, the running carriages will cover exactly half the distance of the pull-out rails. This gives rise to so-called carriage running errors. In other words, the position of the running carriages in relation to the support rails and pull-out rails is not correct. Carriage running errors of this kind can in some cases result in the drawer staying open in normal use.

Carriage running errors are not new; they occur repeatedly with pull-out guide assemblies in which the load of the drawer is transmitted by rollers which are not borne on the rails but in separate running carriages. If the drawer is only moved manually, these errors are in many cases not noticed. If the drawer is pulled into the final closed position by a conventional closing system having springs, in most cases there is sufficient momentum for the carriage running error to be corrected by the dynamic of the drawer and for the drawer always to close.

In modern pull-out guides for drawers, closing devices are provided that are additionally equipped with a damping means so that the drawer is not pulled into the furniture carcass with too much force. However, these damping means reduce the closing dynamic of the drawer such that a carriage running error occurring while the drawer is moving can no longer be compensated because there is insufficient momentum at the movement.

OBJECT OF THE INVENTION

The object of the invention is to improve the pull-out guide assembly of the type mentioned at the outset such that the carriage running errors are corrected and hence correct closing of the drawer is achieved.

SUMMARY OF THE INVENTION

The object according to the invention is achieved in that, in the event of a deviation from the differential running between the rails and the running carriages, a locking device locks the running carriages on one of the rails at predetermined points between their two end positions, with this locking being releasable by the movement of the rails with respect to one another.

An example embodiment of the invention provides for each running carriage to be provided with two locking devices that lock the running carriage in opposing directions.

Advantageously, in this case it is provided for the locking devices to be formed by levers that are mounted rotatably on the running carriages. The levers are preferably constructed as double-arm levers.

A further example embodiment of the invention provides for the locking devices to be formed by resilient arms that project horizontally from the running carriages in the direction of movement, for the arm of a running carriage to abut against a stop of a rail upon locking, and for in each case a second rail to be provided with a counter-stop that abuts against the projecting arm of the running carriage on locking and so prevents deflection of the arm with respect to the stop on the first rail.

A further example embodiment of the invention provides for the locking devices to be formed by rockers that are borne tiltably on the running carriages and have two stop faces that abut against a stop of one of the rails in the event of a running carriage deviating from the differential running between the rails.

In a further embodiment of the invention a central rail is arranged between the support rail and the pull-out rail with a running carriage running between the support rail and the central rail and another running carriage running between the central rail and the pull-out rail.

BRIEF DESCRIPTION OF THE DRAWINGS

The present invention will be better understood from the accompanying drawings, in which:

FIGS. 4*a* to 4*e* show side views of the pull-out guide assembly in various positions, with the running carriage shown with two levers, FIG. 5 shows a cross-section through an example embodiment of a pull-out guide assembly.

DETAILED DESCRIPTION OF THE INVENTION

Figure 1:
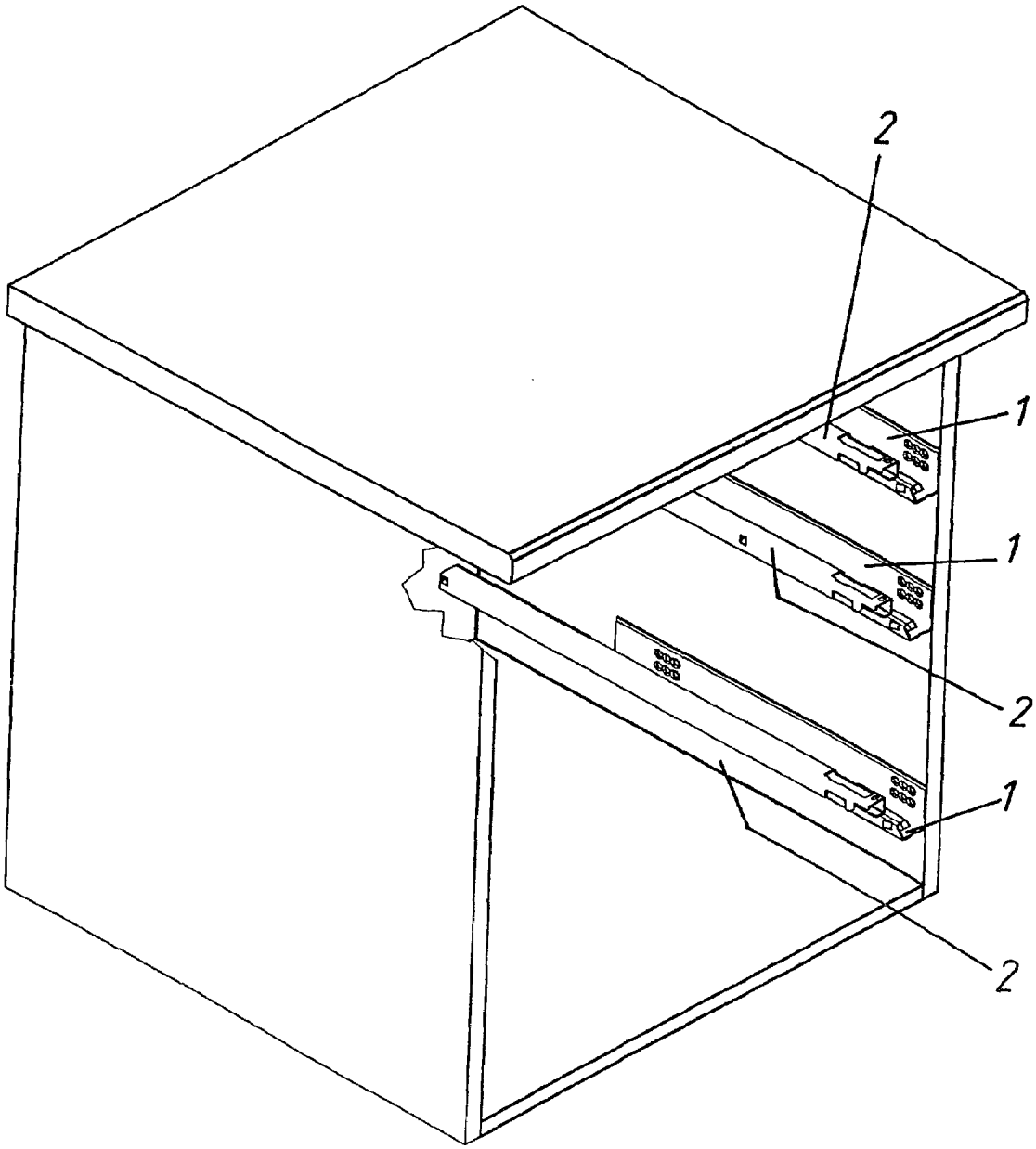
FIG. 1 shows a view of a cabinet-like piece of furniture that is equipped with pull-out guide assemblies according to the invention.
Figures 2A, 2B, 2C, 2D, 2E:
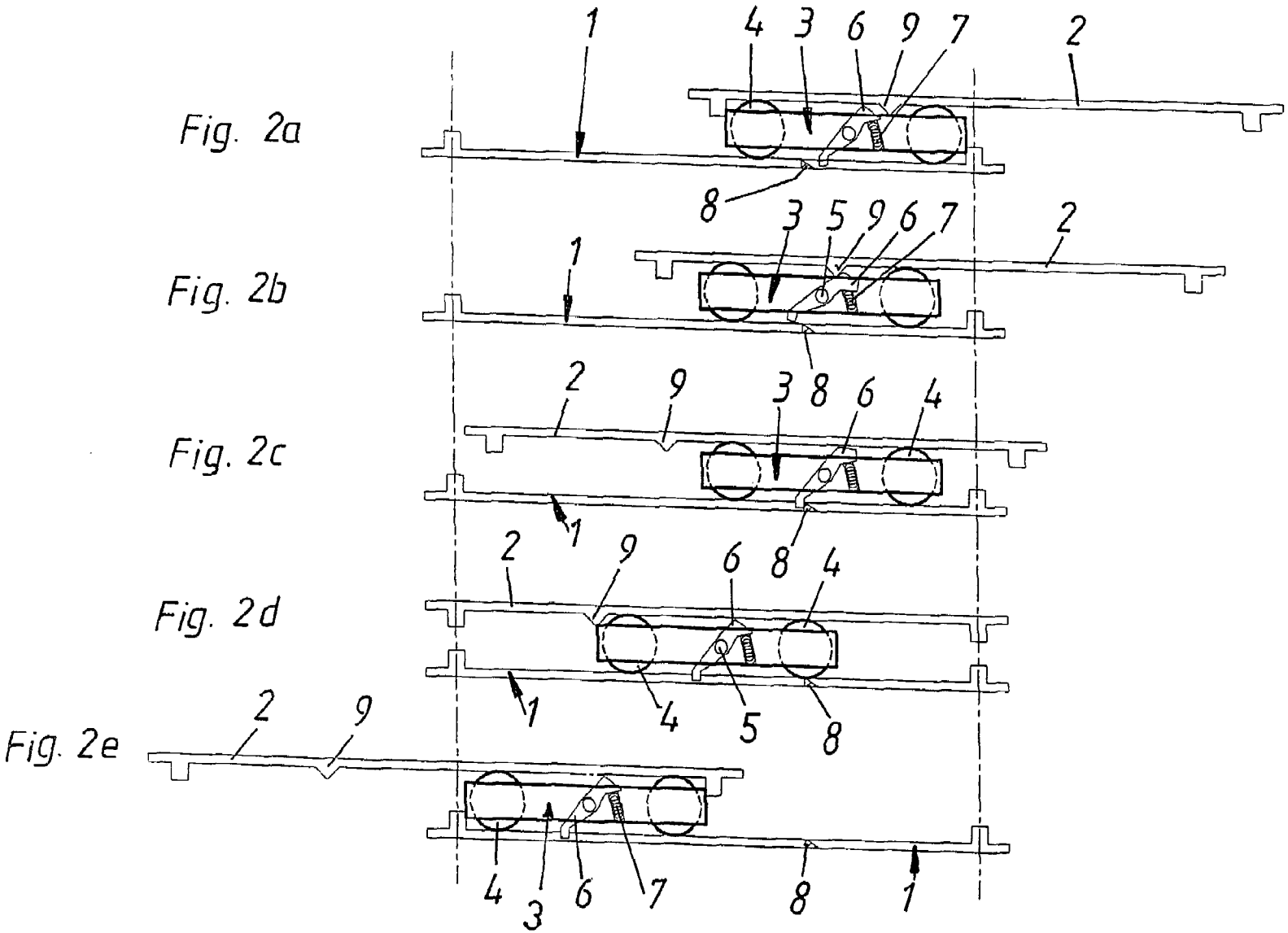
FIG. 2*a* shows diagrammatically one side of a pull-out guide assembly having a pull-out rail, a running carriage and a support rail, in which the pull-out guide assembly is shown in the closed position.
FIGS. 2*b* to 2*d* show side views of the pull-out guide assembly in which the pull-out rail is shown in various intermediate positions, with a leading running carriage shown.
FIG. 2*e* shows a side view of the pull-out guide assembly, in which the pull-out rail is shown in the fully extended position of the draw.

In each embodiment described below, only one side of a pull-out guide fitting will be described, as arranged on one side of the drawer. The opposite side of the drawer is of analogous construction.

The pull-out guide assembly according to the invention may be constructed as a simple pull-out guide assembly having on each side of the drawer a support rail 1 on the carcass and a pull-out rail 2 on the drawer. However, the assembly may also be constructed as a differential pull-out means, in which case a central rail 27 is arranged on each side of the drawer between the pull-out rail 2 and the support rail 1 (see FIGS. 18 and 19).

In the embodiments shown in FIGS. 2 to 17, the pull-out guide assembly comprises on each side of the drawer a support rail 1 on the carcass and a pull-out rail 2 on the drawer, with a running carriage 3 arranged between the rails 1, 2 and serving as a cage for rollers 4.

In the example embodiments, the rollers 4 are constructed as cylindrical rollers. However, they may also be constructed as balls, or a running carriage 3 may be equipped with a combination of balls and rollers.

In the example embodiment according to FIGS. 2 to 5, the running carriage 3 is provided in its center with two double-arm levers 6 that are tiltable about a horizontal axis pin 5 and which serve as locking devices. The levers 6 are acted upon by pressure springs 7.

In FIGS. 2*a* to 2*d* and 3*a* to 3*d*, for the sake of better clarity, only one of the levers 6 coming into operation in one direction upon locking is shown on the running carriage 3 in each case.

FIGS. 2*a* to 2*e* show a particular situation of a leading running carriage 3. The running carriage 3 is too far in front with respect to the rails 1, 2. When the pull-out rail 2 is moved into the furniture carcass (in an inward direction from left to right; figures are in the order 2*e* to 2*a*), the leading running carriage 3 runs along with the pull-out rail 2 until the lever 6 abuts against the stop 8 of the support rail 1 by means of its hook, which is constructed on the free end, and is caught there. The running carriage 3 is locked at this point, while the pull-out rail 2 continues to move in the inward direction into the furniture carcass, in relation to the running carriage 3 and the support rail 1.

A stop 9 is constructed on the pull-out rail 2. When the stop 9 comes up against the upper end of the lever 6, the pull-out rail 2 is in the correct position relative to the running carriage 3. The lever 6 is tilted (rotated) clockwise and locking of the running carriage 3 against the stop 8 is released, whereupon the running carriage 3 moves in the inward direction into the end position with precise differential movement between the pull-out rail 2 and the support rail 1.

Thus, in this case, the running carriage 3 moves in the inward direction until encountering stop 8, at which time it becomes locked to support rail 1. After being released by stop 9 on pull-out rail 2, the running carriage 3 can continue to move in the inward direction until reaching the final end position.

In cases in which the pull-out rail 2 is moved into its final end position by a relatively weak pull-in device, such as a pull-in device having a damping means, the running carriage 3 does not constitute any obstacle.

FIGS. 3*a* to 3*e* show the situation with a lagging running carriage 3. The running carriage 3 is too far behind with respect to the movement of the pull-out rail 2 (see FIG. 3*e*). Once the pull-out rail 2 has been brought into the position shown in FIG. 3*d* when the drawer is pushed in, the running carriage 3 is so far behind that the pull-out rail 2 latches into the hook-like end of the lever 6 by means of the hook 10 thereof. When the pull-out rail 2 is moved into the position shown in FIG. 3*c*, it carries the running carriage 3 along with it, in other words the running carriage 3 does not travel in differential manner between the pull-out rail 2 and the support rail 1 but is moved at the same speed as the pull-out rail 2.

Figures 3A, 3B, 3C, 3D, 3E:
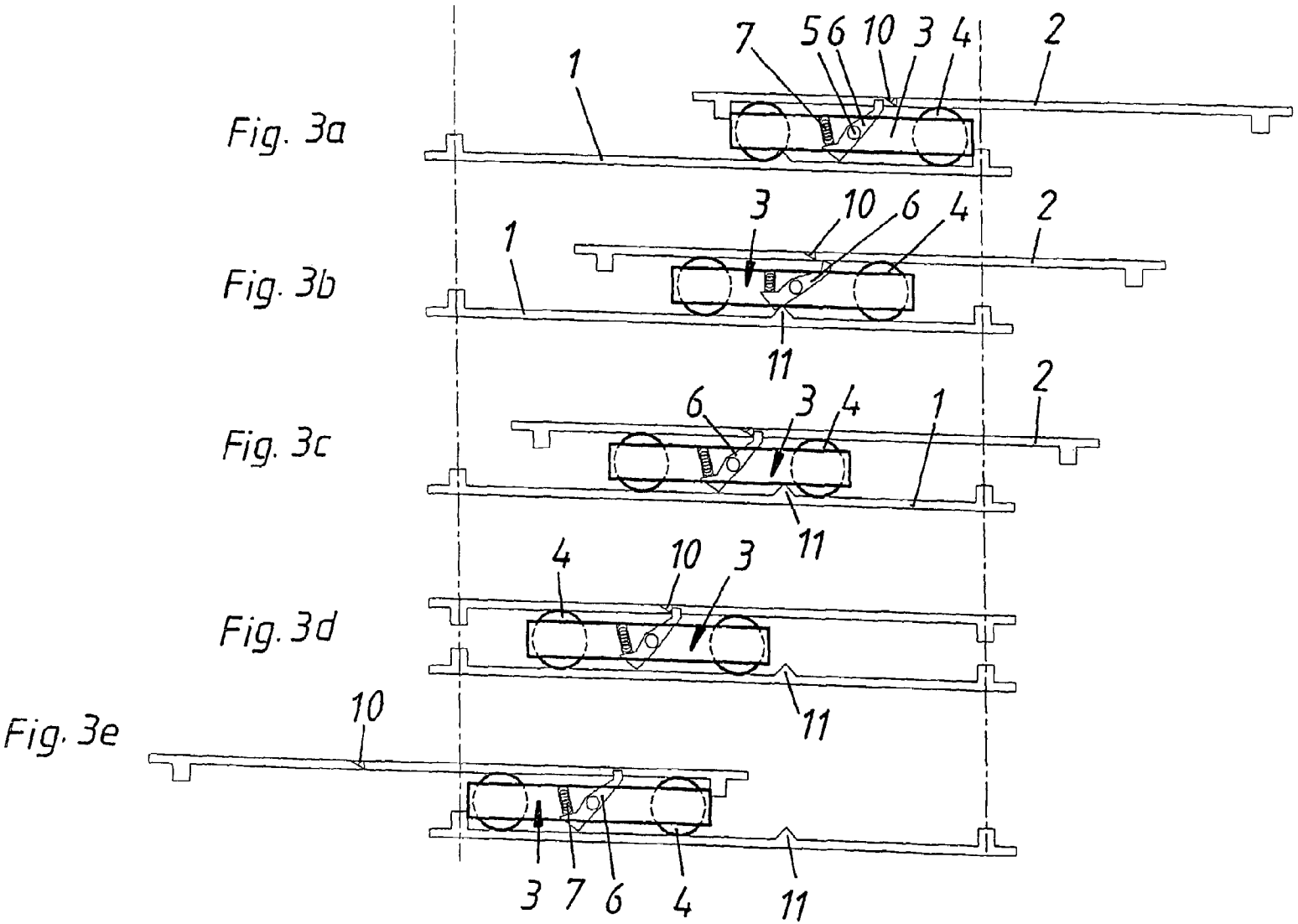
FIGS. 3*a* to 3*e* show the same side views as FIGS. 2*a* to 2*e*, with a lagging running carriage shown.

As soon as the pull-out rail 2 and the running carriage 3 have reached the position shown in FIG. 3*b*, the lever 6 abuts (by means of its lower end) against the stop 11 of the support rail 1 and is uncoupled from the stop 10 of the pull-out rail 2. In the next section of the push-in travel, the running carriage 3 runs correct by differential between the pull-out rail 2 and the support rail 1. Once again, there is no braking action acting on the pull-out rail 2.

As can be seen from FIG. 5, the two levers 6 are arranged on one side of the running carriage 3. The stops 8, 9, 10 and 11 are constructed on horizontal webs 2', 1' of the pull-out rail 2 and the support rail 1, and are laterally offset with respect to the rollers 4. Both when the running carriage 3 is leading and when the running carriage 3 is lagging, the position of the running carriage 3 is corrected before it reaches the end region of the push-in travel. At this point, the pull-out rail 2 is still being pushed into the carcass, or moved with momentum, by the person using the drawer. The relatively weak pull-in device is not yet engaged at this time. The pull-in device is only engaged in the end region of the pull-in travel, and the running carriage 3 is then in the correct position.

In the embodiment according to FIGS. 6*a* to 6*f*, the locking means for the running carriage 3 is formed by a horizontal arm 12 projecting in the direction of displacement of the running carriage 3. The arm 12 is provided with a lug 13 at its free end.

The support rail 1 has a stop 14 at the front and the pull-out rail 2 has a stop 15. If the drawer and hence the pull-out rail 2 are pushed out of the extended position shown in FIG. 6*f* into the furniture carcass, the running carriage 3 runs at first differentially between the pull-out rail 2 and the support rail 1. If the running carriage 3 leads, as shown in FIGS. 6*a* to 6*f*, the lug 13 abuts against the stop 14 while the stop 15 of the pull-out rail 2 is still above the arm 12. The stop 15 thus prevents the resilient arm 12 from being able to be deflected by the stop 14.

While the pull-out rail 2 is being pushed further into the furniture carcass, the running carriage 3 is locked by the stop 14 and remains stationary on the support rail 1.

Figures 6A, 6B, 6C, 6D, 6E, 6F:
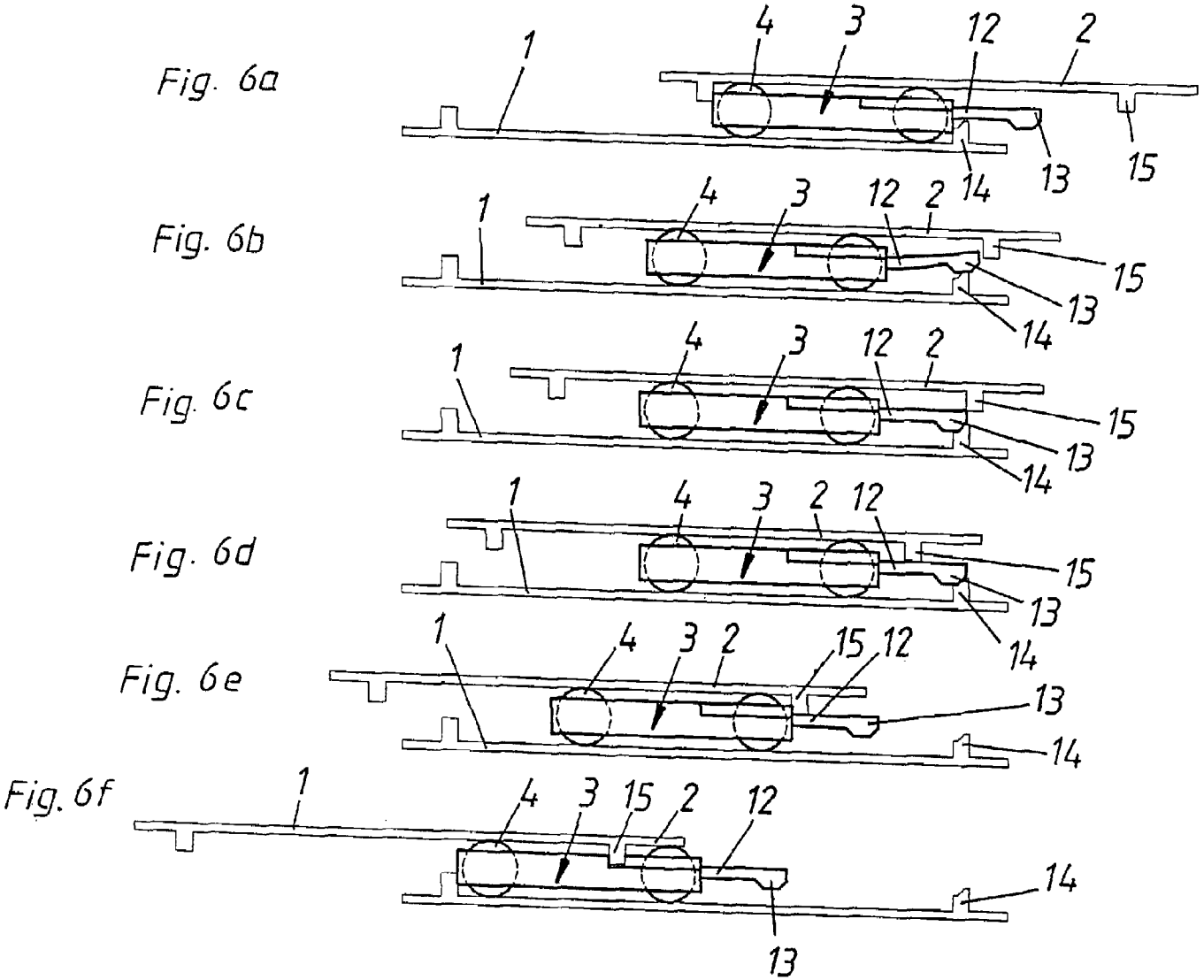
FIGS. 6*a* to 6*f* show side views of a further example embodiment of a pull-out guide assembly according to the invention, in various positions.
Figure 7:
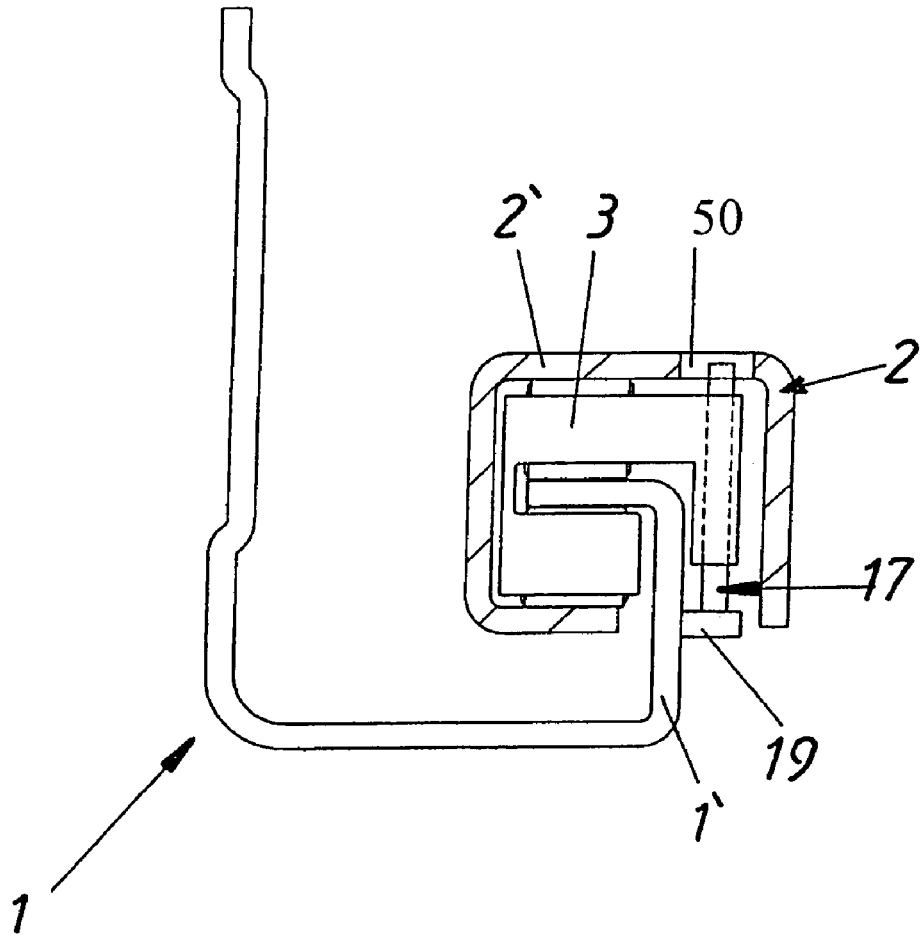
FIG. 7 shows an end view of a further example embodiment of a pull-out guide assembly according to the invention.
Figure 8:
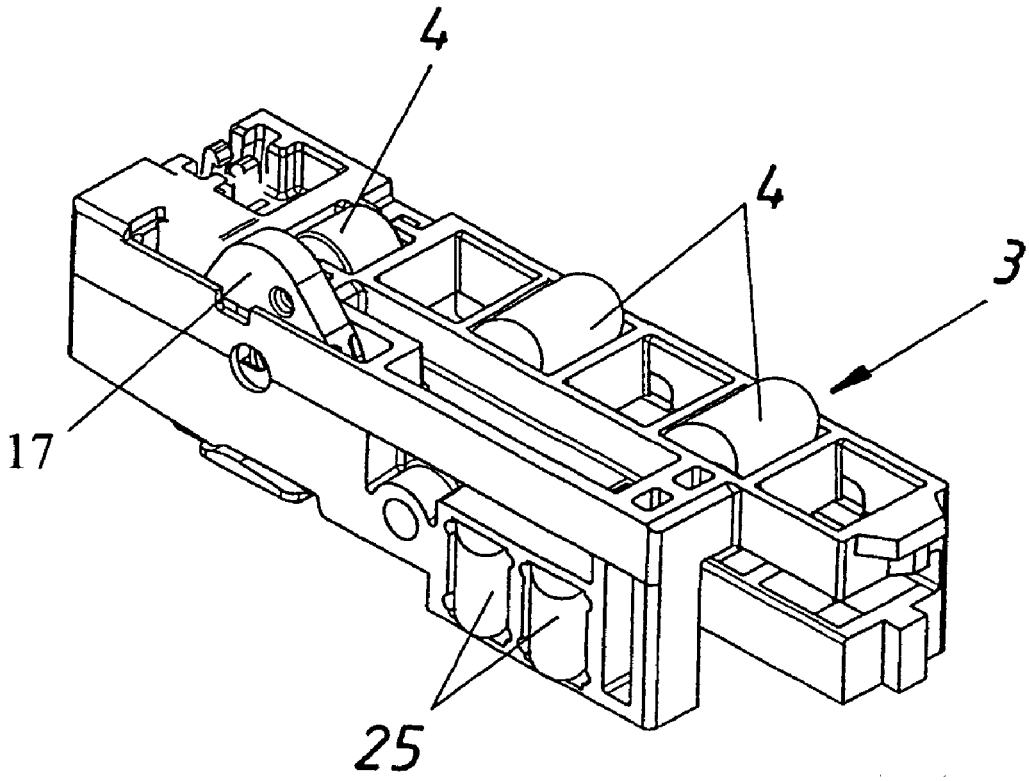
FIG. 8 shows a view of a further example embodiment of a running carriage according to the invention.
Figure 9:
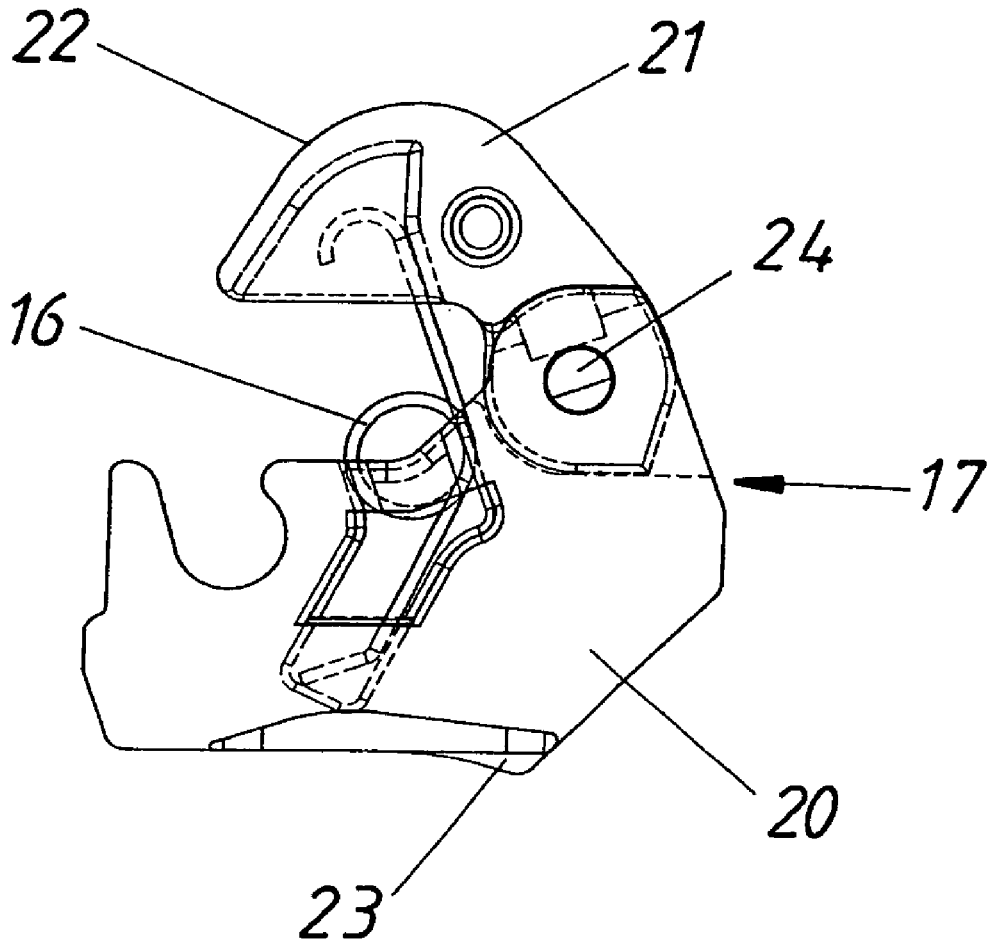
FIG. 9 shows a cut-away diagram of a rocker.
Figure 10:
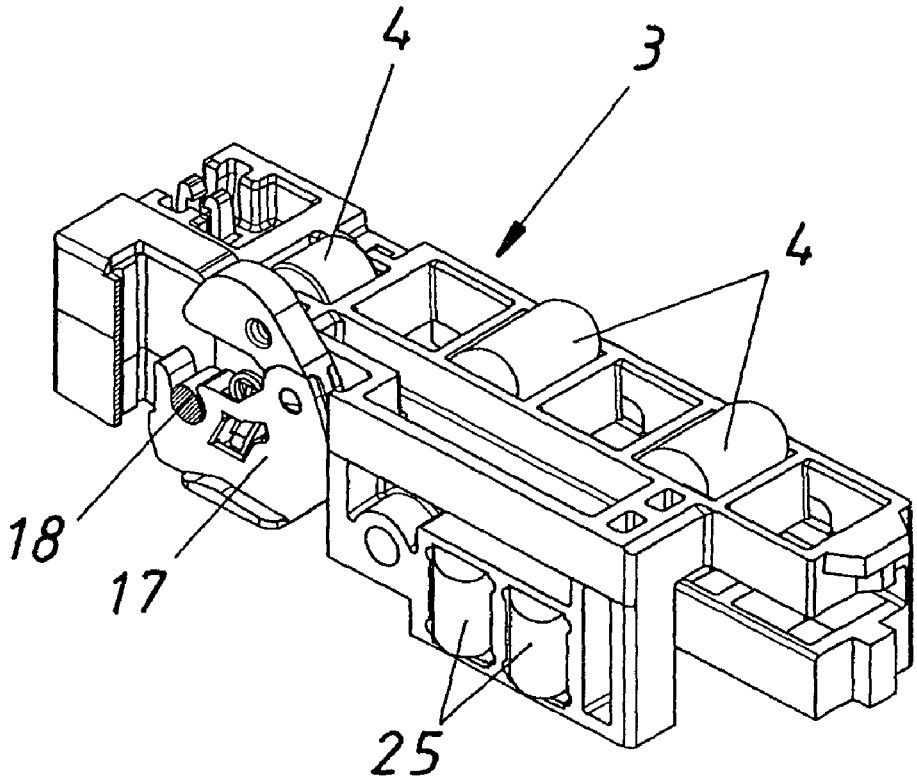
FIG. 10 shows a view of a running carriage according to the invention, in which one wall has been cut away to show the rocker.
Figure 11:
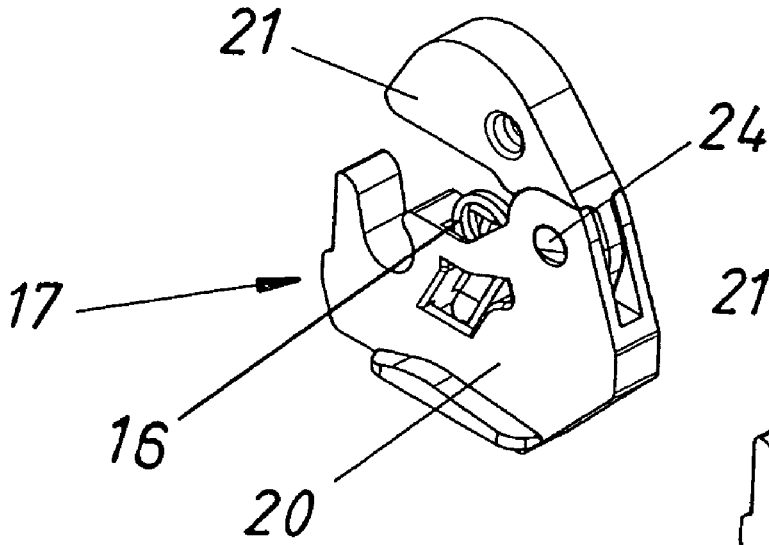
FIG. 11 shows a view of a rocker.
Figure 12:
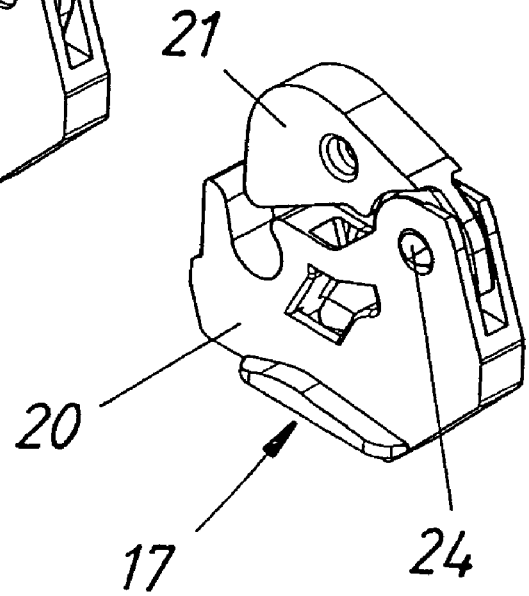
FIG. 12 shows a further view of a rocker.

As soon as the stop 15 of the pull-out rail 2 is moved out over the arm 12, as shown in FIG. 6*c*, the arm 12 can be deflected by the stop 14 by means of the lug 13, whereupon the running carriage 3, which is now in the correct position in relation to the pull-out rail 2, is moved on differentially between the pull-out rail 2 and the support rail 1.

In the example embodiments according to FIGS. 7 to 17, the running carriage 3 is provided in its center with a rocker 17 that can tilt about a horizontal axis pin 18 and serves as a locking means for the running carriage 3.

The pull-out rail 2 has an upper horizontal web 2' with an opening 50 that serves as a deflection unit. The support rail 1 has a tab 19 that projects laterally from a vertical web 1' and forms a stop for the rocker 17.

In the embodiment according to FIGS. 9 to 16, the rocker 17 is constructed in two parts and has a first part 20 that is borne directly on the axis pin 18, preferably snapped onto the latter, and a second part 21 that is borne on the first part 20 such that it can tilt about an axis pin 24. The parts 20, 21 each have a stop face 22, 23. A spring 16, preferably a leg spring, is borne in the rocker 17 and tilts the part 21 upward in relation to the part 20.

Figure 13A:
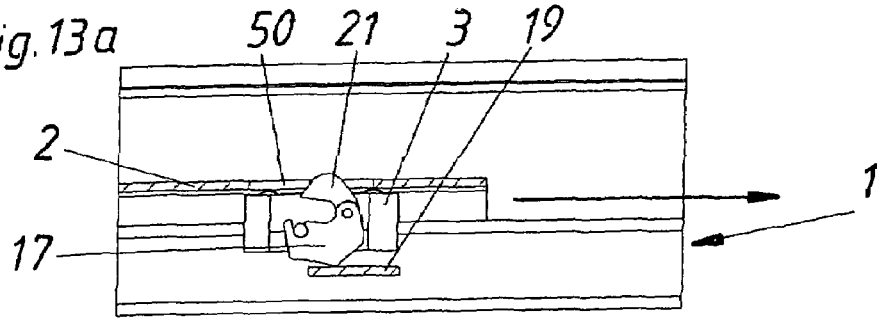
FIGS. 13*a* to 13*e* show diagrammatic side views of a pull-out guide assembly according to the invention in the region of the running carriage, in which the pull-out rail is moved to the right and an ideal movement sequence with no carriage running errors is shown.
Figure 13B:
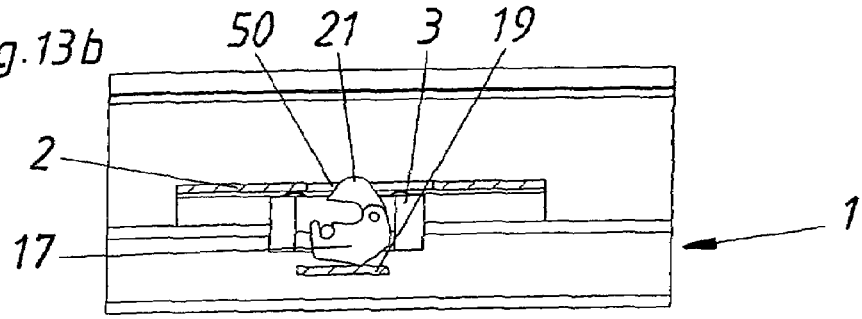
Figure 13C:
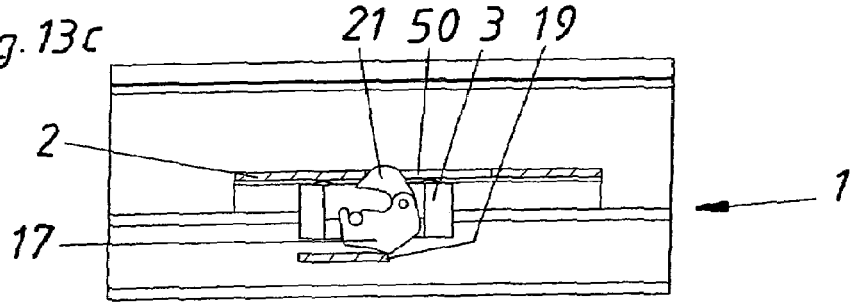
Figure 13D:
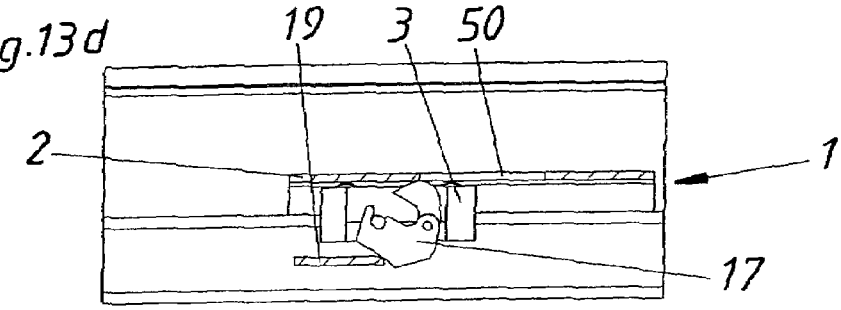
Figure 13E:
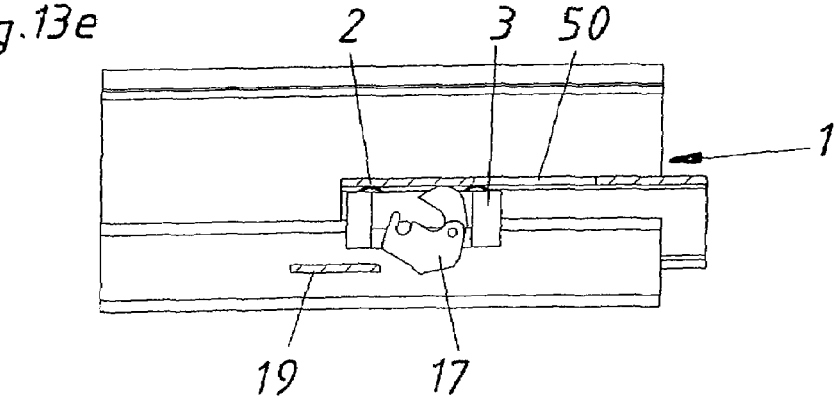
Figure 14A:
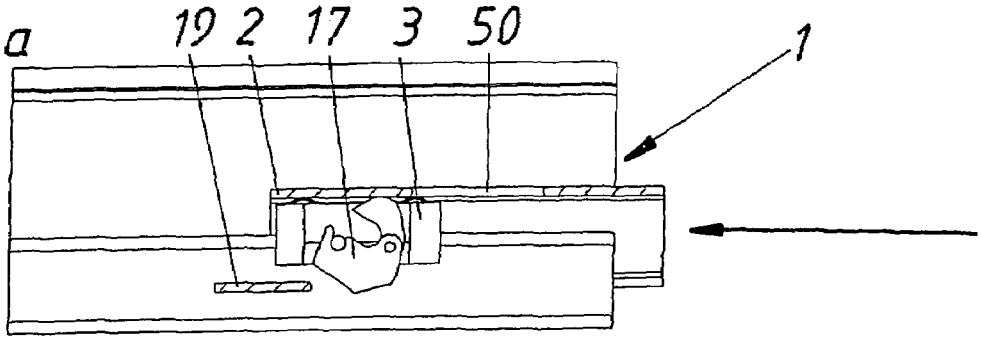
FIGS. 14*a* to 14*e* show a purely diagrammatic side view of a pull-out guide fitting according to the invention in the region of the running carriage, in which the pull-out rail is moved to the left and once again an ideal movement sequence with no running carriage errors is shown.
Figure 14B:
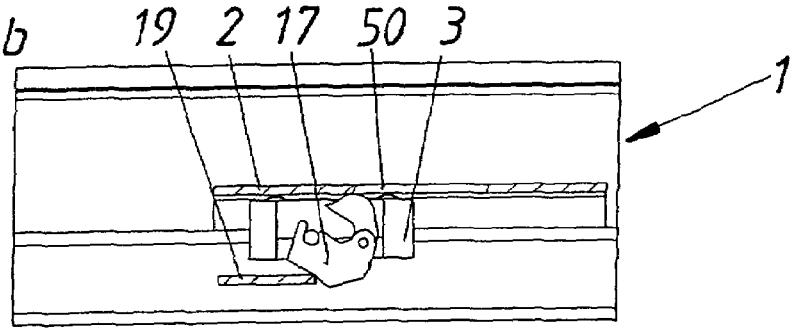
Figure 14C:
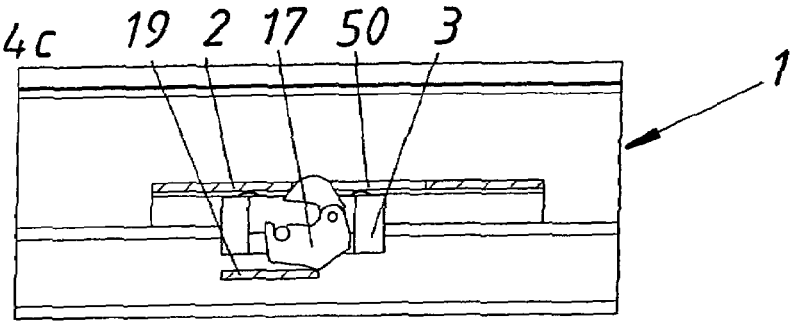
Figure 14D:
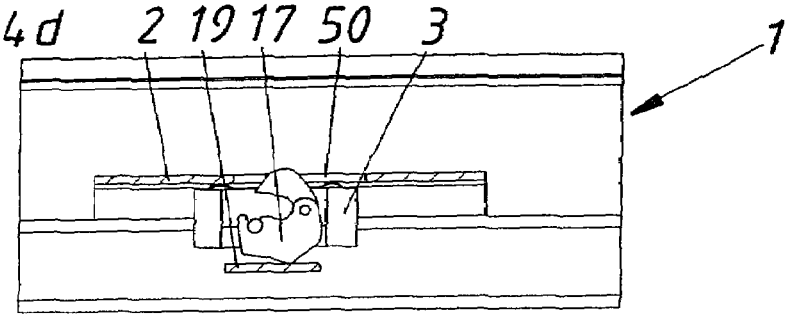
Figure 14E:
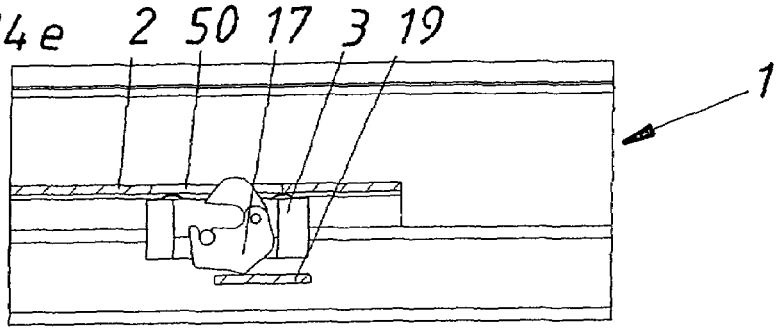

FIGS. 13*a* to 13*e* show an ideal movement sequence with no carriage running errors, in which the pull-out rail 2 is moved to the right (a first direction). The running carriage 3 is also moved to the right (the first direction), and the rocker 17 abuts against the stop of the support rail 1, this stop being formed by the tab 19. This movement turns the rocker 17 clockwise as viewed in the drawing. During this movement, the upper (second) part 21 of the rocker 17 moves into the opening 50 in the pull-out rail 2. As the pull-out rail 2 is moved further to the right, the rocker 17 is turned clockwise until the upper part 21 of the rocker 17 moves down out of the opening 50 (FIGS. 13*d*, 13*e*). The interaction between the tab 19, the opening 50 and the rocker 17 is ideal. No correction of the running carriage 3 is performed. In other words, there is no correction of the position of the running carriage 3 in relation to the rails 1, 2.

FIGS. 14*a* to 14*e* also show a movement sequence with no running carriage errors, in which the pull-out rail 2 is moved to the left. The rocker 17 of the running carriage 3 once again comes up against the tab 19, and the rocker 17 is turned counterclockwise as viewed in the drawing, with the upper (second) part 21 of the rocker 17 turned to move into the opening 50 of the pull-out rail 2. The interaction of the tab 19, the opening 50 and the rocker 17 is once again ideal. No correction of the movement of the running carriage 3 is performed. The running carriage 3 runs precisely differentially between the pull-out rail 2 and the support rail 1.

Figure 15A:
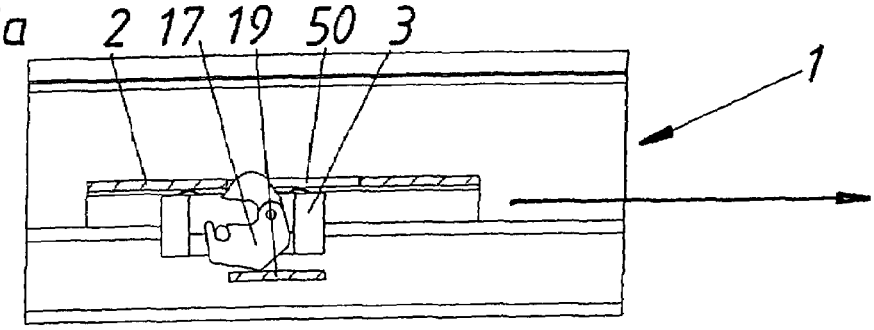
FIGS. 15*a* to 15*e* show a purely diagrammatic side view of a pull-out guide assembly according to the invention in the region of the running carriage, in which the pull-out rail is moved to the right and a movement sequence with carriage running errors is shown.
Figure 15B:
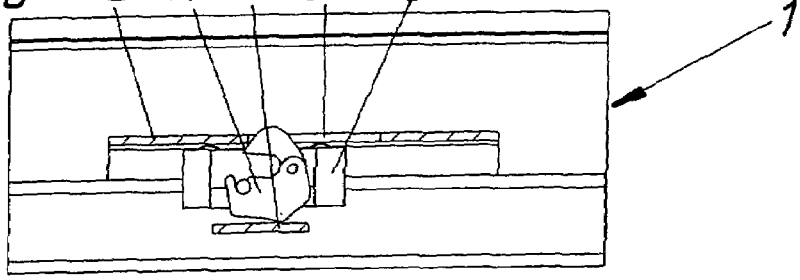
Figure 15C:
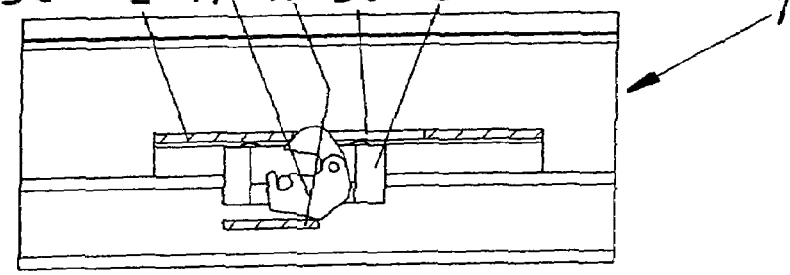
Figure 15D:
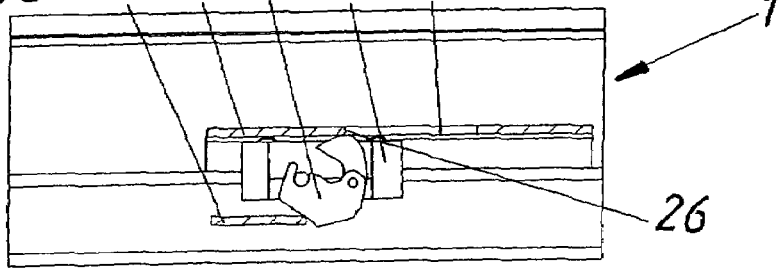
Figure 15E:
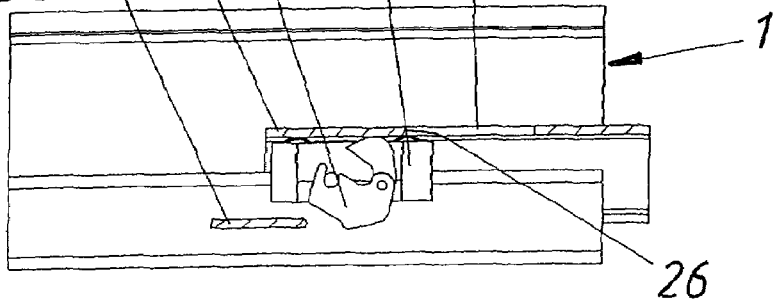

FIGS. 15*a* to 15*e* show a movement sequence with a carriage running error, in which the pull-out rail 2 is moved to the right (the first direction). As shown in FIG. 15*a*, the edge 26 of the opening 50 comes up against the stop face 22 of the rocker 17 at a first predetermined point. The rocker 17 cannot, however, tilt away downward because of the tab 19 on the support rail 1. This has the result that the running carriage 3 is fixed (locked) to the pull-out rail 2 and moves with the pull-out rail 2 at the same speed until the rocker 17 can tilt down over the end of the tab 19 at a second predetermined point (FIG. 15*c*). FIGS. 15*d* and 15*e* show the running carriage 3 in the corrected position, and show how the running carriage 3 can continue to move in the first direction after the locking device (edge 26, rocker 17, and tab 19) releases the running carriage 3 from being locked to pull-out rail 2.

FIGS. 16*a* to 16*e* show a movement sequence with a carriage running error, in which the pull-out rail 2 is moved to the left.

Figure 16A:
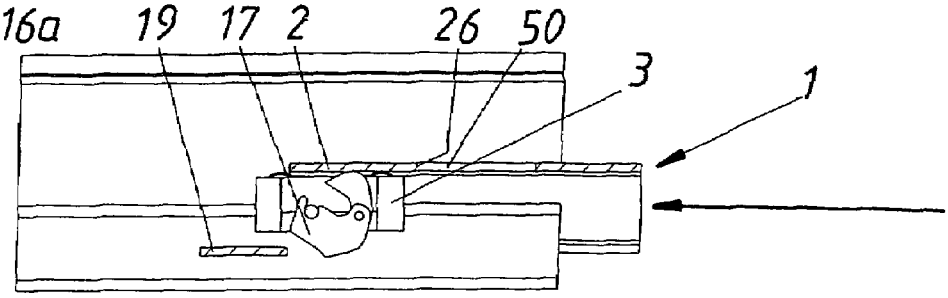
FIGS. 16*a* to 16*e* show a purely diagrammatic side view of a further example embodiment of a pull-out guide fitting according to the invention in the region of the running carriage, in which the pull-out rail is moved to the left and a movement sequence with carriage running errors is shown.
Figure 16B:
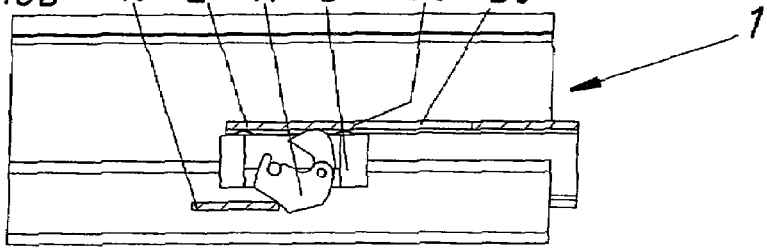
Figure 16C:
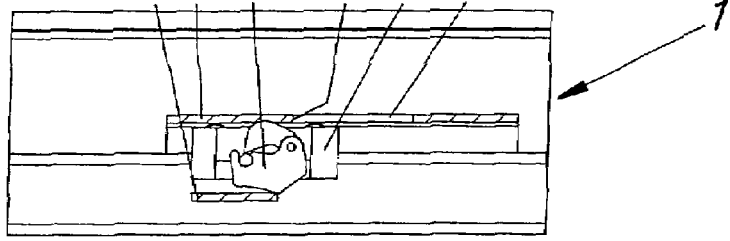
Figure 16D:
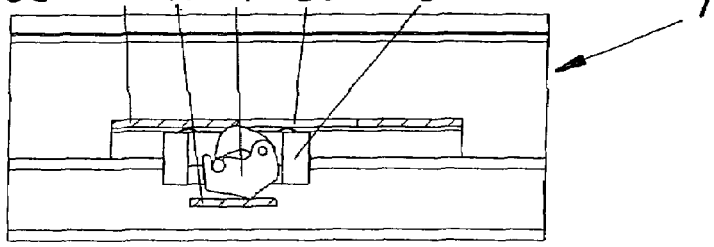
Figure 16E:
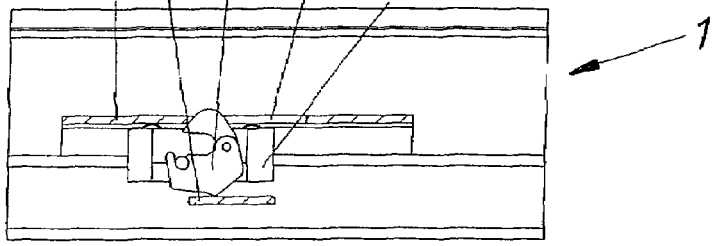

In FIG. 16*b*, the rocker 17 is in contact with the tab 19 forming the stop of the support rail 1, and the rocker 17 begins to turn counterclockwise. This rotation is possible, despite the incorrect position of the running carriage 3, since the rocker 17 is constructed in two parts and the upper (second) part 21 of the rocker 17 can tilt with respect to the lower (first) part 20 of the rocker 17. There is no correction of the movement of the running carriage 3.

With this construction, it is possible to choose whether a correction of the running position of the carriage 3, when a carriage running error occurs (error in the position of the running carriage 3 in relation to the rails 1, 2), is to be performed only when the drawer is opened or only when the drawer is closed. Generally, it is desirable for the correction of the running carriage 3 to be performed when the drawer is opened, since upon opening, the drawer is moved manually at full force and the resistance of the running carriage 3 when the correction is made is not noticeable.

FIGS. 17*a* to 17*e* show a one-part rocker 17 that is constructed in one piece and is not acted upon by a spring. In the example embodiment shown, the pull-out rail 2 moves to the left. A movement sequence with a running carriage 3 error is shown.

Figure 17A:
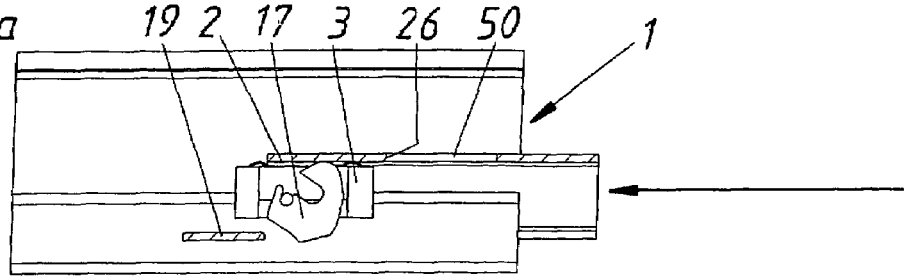
FIGS. 17*a* to 17*e* show a diagrammatic side view of a pull-out guide assembly according to the invention in the region of the running carriage, in which the pull-out rail is moved to the left and a movement sequence with carriage running errors is shown.
Figure 17B:
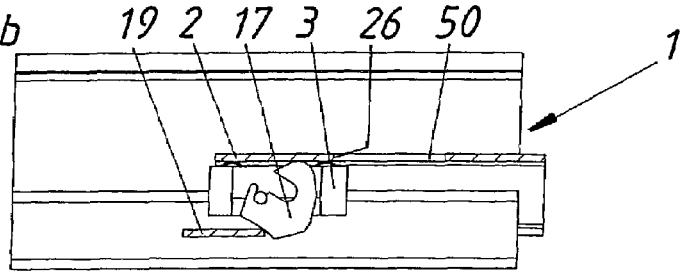
Figure 17C:
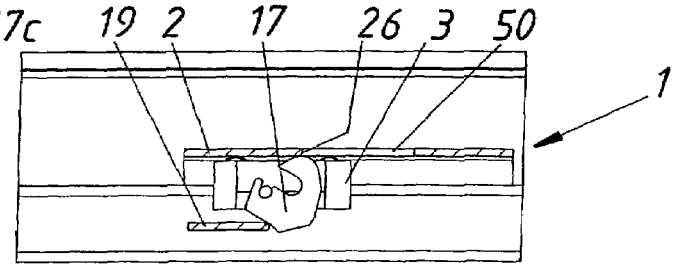
Figure 17D:
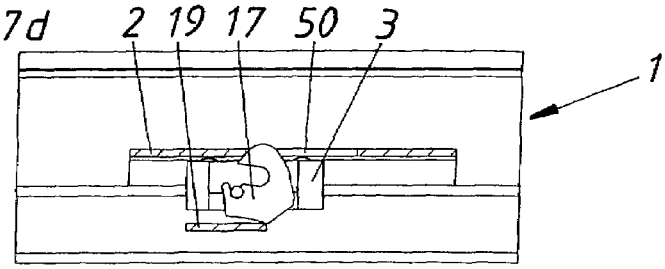
Figure 17E:
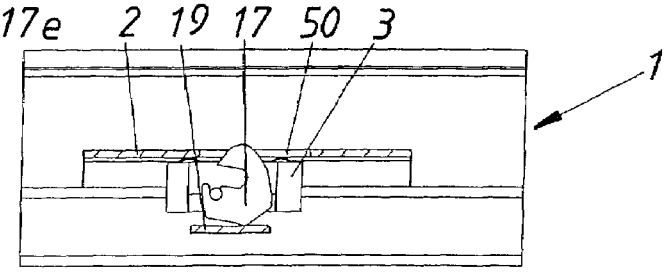

The rocker 17 meets the tab 19 (FIG. 17*b*). Because it is rigid and cannot fold together, and because it abuts against the horizontal web 2' of the pull-out rail 2, the rocker 17 cannot rotate. The running carriage 3 is therefore coupled to the support rail 1 and remains stationary until the pull-out rail 2 has been moved far enough to the left for the opening 50 to make it possible for the rocker 17 to pivot. This happens at the moment when the running carriage 3 is in the correct running position in relation to the rails 1, 2.

It is an essential part of the invention that the position of the running carriage 3 in relation to the rails 1, 2 is always corrected between the two end positions of the pull-out rail 2 (in other words, not directly as the drawer is finally closed), and the pull-out rail 2 is pulled into the furniture carcass by a pull-in device.

Figure 18:
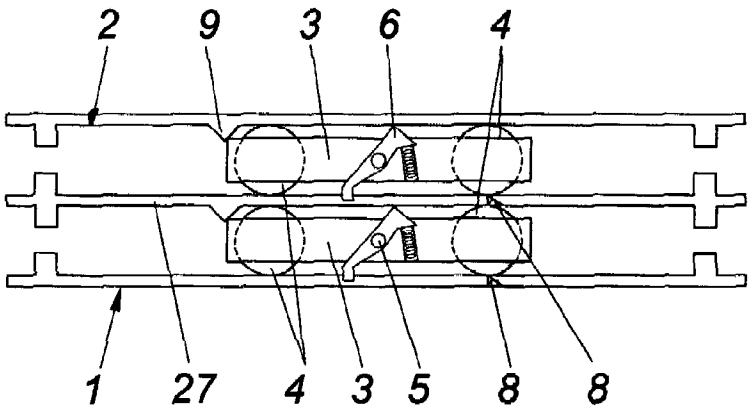
FIG. 18 shows a diagrammatic side view of a pull-out guide assembly according to the invention in which a central rail is provided, the rails being shown in their rearmost position.
Figure 19:
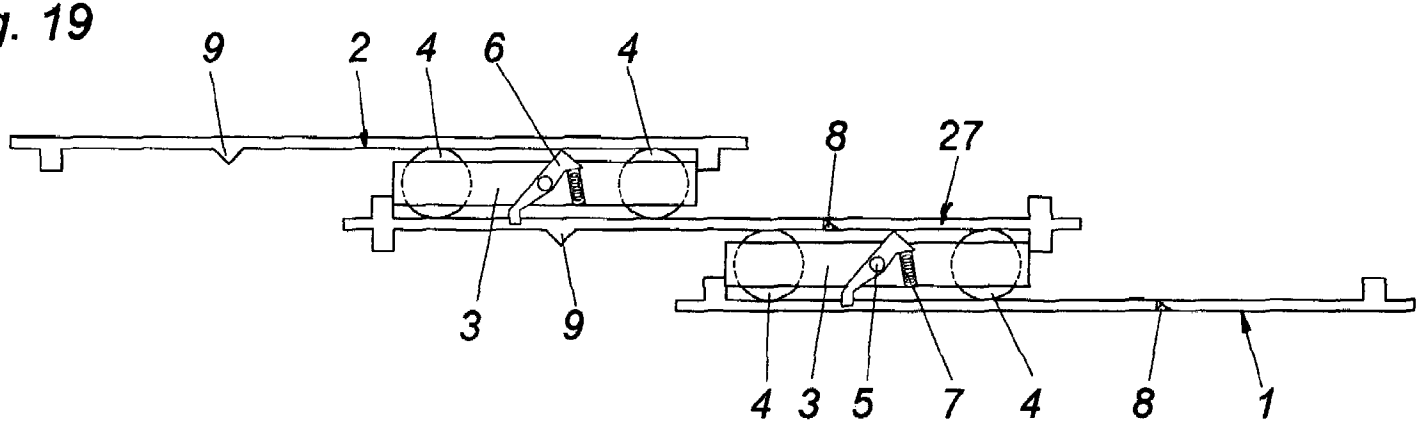
FIG. 19 shows a diagrammatic vie of the pull-out guide assembly of FIG. 18, the rails being shown in their foremost position.

FIGS. 18 and 19 show an embodiment where a central rail 27 is provided between the pull-out rail 2 and the support rail 1. A first running carriage 3 is positioned between the pull-out rail 2 and the central rail 27, and a second running carriage 3 is positioned between the central rail 27 and the support rail 1. Correction of the position of the running carriages 3 is achieved in the same way as in the embodiments described before. The only difference is that the interaction takes place between the pull-out rail 2 and the central rail 27, and the central rail 27 and the support rail 1 respectively and not between the pull-out rail 2 and the support rail 1.

What is claimed is:

1. A pull-out guide assembly for a drawer, comprising:

a support rail to be mounted on a carcass;

a pull-out rail to be mounted on the drawer; and a running carriage mounted between said support rail and said pull-out rail and operable to move between a front end position and a rear end position in a differential manner, said running carriage including:

rollers for transmitting a load of the drawer between said support rail and said pull-out rail; and a locking device operable to lock said running carriage to said pull-out rail at a first predetermined point located between said front end position and said rear end position, and operable to unlock said running carriage from said pull-out rail at a second predetermined point located between said front end position and said rear end position due to relative movement between said support rail and said pull-out rail;

wherein said support rail, said pull-out rail, and said running carriage are arranged and interconnected such that, if said running carriage is locked to said pull-out rail at said first predetermined point by said locking device while moving toward one of said front end position and said rear end position, said running carriage is operable to continue moving toward said one of said front end position and said rear end position in the differential manner after being unlocked by said locking device at said second predetermined point; and wherein said locking device comprises a rocker tiltably mounted on said running carriage, said rocker having two stop faces shaped to abut against a stop on each of said support rail and pull-out rail.

2. The pull-out guide assembly of claim 1, wherein said support rail has a stop and said pull-out rail has a deflection unit for receiving said locking device.

3. The pull-out guide assembly of claim 2, wherein said deflection unit comprises an opening in a horizontal web of said pull-out rail.

4. The pull-out guide assembly of claim 3, wherein said stop comprises a first stop, said pull-out rail having a second stop, said second stop comprising an edge of said opening.

5. The pull-out guide assembly of claim 2, wherein said stop comprises a horizontal tab.

6. The pull-out guide assembly of claim 1, wherein said tiltable rocker has an adjustable shape.

7. The pull-out guide assembly of claim 1, wherein said tiltable rocker comprises a first part and a second part connected to each other in an articulated manner, each of said first part and said second part having a stop face.

8. The pull-out guide assembly of claim 7, wherein said first part is tiltably mounted on said running carriage by an axis pin, and said second part is tiltably mounted on said first part by an axis pin.

9. The pull-out guide assembly of claim 1, wherein a first one of said stop faces is concave, and a second one of said stop faces is convex.

10. The pull-out guide assembly of claim 1, wherein said locking device is operable to lock said running carriage to said pull-out rail at said first predetermined point if a position of said running carriage with respect to said support rail and said pull-out rail is incorrect so as to thereby correct the position.

11. A pull-out guide assembly for a drawer, comprising:

a pair of support rails to be mounted on opposite sides of a carcass;

a pair of pull-out rails to be mounted on opposite sides of the drawer; and running carriages mounted between said support rails and said pull-out rails and operable to move between a front end position and a rear end position in a differential manner, each of said running carriages including:

rollers for transmitting a load of the drawer between said support rails and said pull-out rails; and a locking device operable to lock said running carriage to a respective one of said pull-out rails at a first predetermined point located between said front end position and said rear end position, and operable to unlock said running carriage from said respective one of said pull-out rails at a second predetermined point located between said front end position and said rear end position due to relative movement between said support rails and said pull-out rails;

wherein said support rails, said pull-out rails, and said running carriages are arranged and interconnected such that, if one of said running carriages is locked to a respective one of said pull-out rails at said first predetermined point by said locking device while moving toward one of said front end position and said rear end position, said running carriage is operable to continue moving toward said one of said front end position and said rear end position in the differential manner after being unlocked by said locking device at said second predetermined point; and wherein said locking device comprises a rocker tiltably mounted on said running carriage, said rocker having two stop faces shaped to abut against a stop on each of said respective support rails and pull-out rails.

* * * * *